US005165337A

United States Patent [19]

Schlundt

[11] Patent Number: 5,165,337

[45] Date of Patent: Nov. 24, 1992

[54] SCREEN PRINTING KIT FOR CHILDREN

[75] Inventor: David W. Schlundt, Hermosa Beach, Calif.

[73] Assignee: Mattel, Inc., El Segundo, Calif.

[21] Appl. No.: 832,261

[22] Filed: Feb. 7, 1992

[51] Int. Cl.[5] ..... B41F 15/02

[52] U.S. Cl. ..... 101/114; 101/127

[58] Field of Search ..... 101/114, 127, 127.1, 101/128.1; 434/87, 162, 163, 164

[56] References Cited

U.S. PATENT DOCUMENTS

| | | | |
|---|---|---|---|
| 2,347,022 | 4/1944 | Austin | 101/127.1 |
| 2,718,190 | 9/1955 | Bean | 101/127 |
| 4,023,524 | 5/1977 | Goldfarb et al. | 101/114 |
| 4,550,660 | 11/1985 | Sato et al. | 101/128.21 |
| 5,000,089 | 3/1991 | Uchiyama | 101/127.1 |

*Primary Examiner*—Clifford D. Crowder
*Assistant Examiner*—Stephen R. Funk
*Attorney, Agent, or Firm*—Roy A. Ekstrand

[57] ABSTRACT

A screen printing kit for children includes a housing defining an interior cavity shaped in a fanciful footprint configuration. The interior cavity of the housing is sufficiently sized to receive and store a plurality of screen printing ink tubes as well as a porous tip pen and cap together with a plurality of screens. A frame is similarly shaped to the housing and fits nestably thereon to complete the closure of the interior cavity. The frame defines a planar upper surface and a generally rectangular recess. The recess is surrounded by an inwardly extending lip defining a rectangular opening therethrough and a plurality of locating posts extending upwardly from the lip. A printing screen includes a rectangular frame member having an opening defined therein and a plurality of locating apertures cooperating with and spaced in correspondence to the locating posts. The frame supports a mesh screen of the type used in screen printing having an impervious film layer extending thereacross. The film layer is formed of a dissolvable material which reacts to the liquid within the porous pen to open selected areas of the screen mesh as the user draws upon the film layer using the dissolvinig pen. A squeegee suitable for use in the screen printing processs is received within an accommodating notch formed in the frame.

6 Claims, 2 Drawing Sheets

SCREEN PRINTING KIT FOR CHILDREN

FIELD OF THE INVENTION

This invention relates generally to screen printing processes and apparatus and particularly to screen printing apparatus which provide individualized printed patterns.

BACKGROUND OF THE INVENTION

The screen printing process has, for many years, provided a variety of decorative and often amusing inked patterns and designs upon cloth items such as scarves, shirts, banners and the ever popular T-shirts. Other processes, such as spray painting generally using stencils or the like, have provided some worthwhile results. However, the general trend within the clothing industry finds that silk-screening processes are superior in that they provide more long lasting ink patterns and are more economical to utilize. Silk-screening processes and apparatus range from the extremely complex, high speed mass production units which produce inked patterns upon clothing or the like at extremely high production rates and high numbers of duplicate items using a common pattern to the more simple custom silk-screening processes. The latter silk-screening processes often provide for individualized silk-screening which facilitates custom design and often hand drawn patterns to be silk-screened.

U.S. Pat. No. 3,282,207 issued to Plymale sets forth a SCREEN PRINTING IN WHICH SCREEN MEMBERS ARE GIVEN RELATIVE MOVEMENT TO CONTROL INK FLOW in which a pair of multiapertured or foraminous screens are positionable in either aligned or overlapping positions to provide controllable screen porosity or complete imperviousness to the screening ink within the process. The result is a screening process in which an electrical control signal is able to open and close the screen members and control the transfer of ink to the screening medium.

U.S. Pat. No. 4,947,744 issued to Petersen sets forth SCREEN PRINTING METHOD in which a flat article upon which printing is to be formed is positioned upon a printing table and secured by vacuum. A screen having a stencil supporting printing ink on its upper surface is lowered against the article afterwhich a squeegee is scraped over the upper surface of the stencil to force ink through the screen and onto the article. Thereafter, the stencil is lifted. An ionizing electrode energized by a direct current voltage is moved in association with the squeegee to improve the printing process.

U.S. Pat. No. 3,527,163 issued to Bean sets forth a SILK SCREEN MASTER in which a xerographic toner image is transferred to a surface of a screen substrate having interstitial spaces which have been filled with a resinous fiber material. The filler and toner material are selected such that each is soluble in a different solution. Following fusion of the toner image to the screen, the resinous filler material is selectively removed to produce a stencil master.

U.S. Pat. No. 3,532,052 issued to Erickson sets forth SILK SCREEN MAKING in which a silk screen stencil is prepared by engaging the screen cloth with a dry layer of photosensitizable colloid carried on a backing member and applying a liquid photosensitized emulsion to the screen cloth to fill the meshes in the screen cloth and simultaneously sensitize the colloid layer and join it to the silk screen. Following the drying process, the backing is removed to provide a complete stencil.

U.S. Pat. No. 3,538,847 issued to Heilman sets forth a METHOD OF MAKING A SCREEN STENCIL in which a stencil is formed in a sheet of metal and secured to a silk screen coated with a photoresist emulsion. The emulsion serves as the bonding agent. The stencil is applied to the screen while the emulsion is wet and pressure is applied until the emulsion dries. The emulsion is then removed in the areas corresponding to the stencil openings.

U.S. Pat. No. 4,852,483 issued to Bussard sets forth a KIT FOR INDIVIDUALIZED SILK SCREEN PRINTING intended for use in printing on T-shirts and the like. The kit includes a carrier loaded with a row of overlapping stencils and a mask for shielding around a printed area.

U.S. Pat. No. 4,477,557 issued to Rauch sets forth a STENCIL MAKING AND UTILIZATION METHODS, APPARATUS AND ARTICLES for producing a desired design by selective hardening of first and second individually soluble substances being hardenable in add mixture in a foraminous stencil blank which is initially impregnated with the first substance. The second substance is stored separately from the stencil blank in a device such as a pen. The second substance is thereafter selectively applied in the form of the desired design to the impregnated stencil blank for add mixture with the first substance immediately prior to a desired selective hardening of the add mixed first and second substances to render part of the stencil imperforate. The stencil is also exposed to dissolution of any applied first and second substances outside of the latter part for rendering the stencil perforate outside of that part.

U.S. Pat. No. 4,550,660 issued to Sato, et al. sets forth a STENCIL which provides a pattern wise perforated stencil easily made by handwriting or the like. The stencil is made up of a porous support and a masking film formed thereon. The masking film is made of a water soluble polymer having tertiary amino groups. The pattern is applied to the stencil using an instrument for imparting a dissolving solution in the desired pattern to the film and screen. The film is dissolved selectively in the pattern applied producing screens which are perforate or pervious to the inking material within the desired pattern.

U.S. Pat. No. 4,569,283 issued to Sato, et al. sets forth a STENCIL MATERIAL SET AND STENCIL DUPLICATOR SET which provides an operative mechanism for use with the screens produced in the above-mentioned Sato, et al. patent (U.S. Pat. No. 4,550,660).

U.S. Pat. No. 4,023,524 issued to Goldfarb, et al. sets forth a TOY SPRAY PAINTING SYSTEM which provides a plurality of interchangeable stencils and a frame support therefor.

U.S. Pat. No. 4,961,377 issued to Bando, et al. sets forth a THERMAL STENCIL MASTER SHEET AND ADHESIVE THEREFOR for stencil printing using a thermoplastic synthetic resin film which is perforatable with heat together with a porous substrate which is substantially unchanged by heat.

While the foregoing described prior art devices have achieved varying degrees of success in improving the screen printing process and art, they have devoted little, if any, attention to providing user friendly conveniently operated silk printing kits which are suitable for use by younger children. There remains, therefore, a continuing need in the art for screen printing kits which are capable of use by younger children and which stimulate the creative process experienced by younger children in the screen printing activity.

SUMMARY OF THE INVENTION

Accordingly, it is a general object of the present invention to provide an improved screen printing kit. It is a more particular object of the present invention to provide an improved screen printing kit suitable for use by younger children. It is a still more particular object of the present invention to provide an improved screen printing kit suitable for use by younger children which facilitates and encourages individual artistic creation by the child user.

In accordance with the present invention, there is provided a screen printing kit, for use by children comprising: a housing defining a planar bottom surface and surrounding upwardly extending sidewall terminating in an upper edge; a frame defining a planar upper surface having a sidewall extending downwardly therefrom and defining a recessed portion, an extending lip extending inwardly within the recessed portion and defining an opening therein; a plurality of locating posts extending upwardly from and spaced about the lip; a squeegee removably attachable to the frame and having a straight wiping edge, the squeegee and the frame defining an outer border generally corresponding to the sidewall of the housing and nestably mating therewith; a printing screen receivable within the recess and having an open foraminous mesh portion, a surrounding frame defining a screen opening therein and a plurality of locating apertures corresponding to the locating posts; an impervious solvent dissolvable material disposed upon the foraminous mesh rendering the mesh impervious; and a pen having a solvent for dissolving the impervious solvent dissolvable material and having a writing nib for transferring the solvent by contact, the pen, the ink and the screens being receivable within the interior cavity for storage when not in use.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
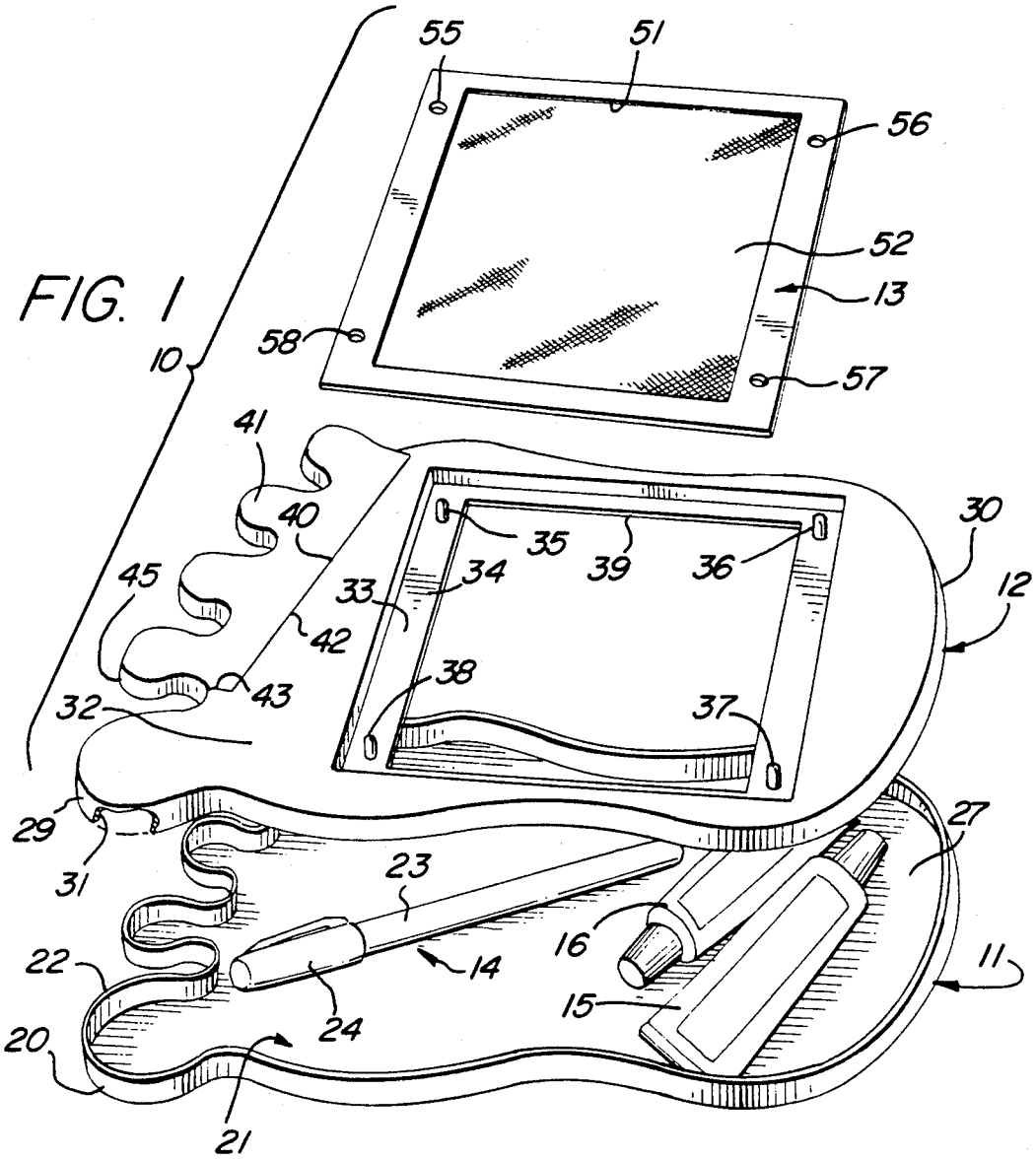
FIG. 1 sets forth a perspective assembly view of a screen printing kit constructed in accordance with the present invention.

FIG. 1 sets forth a perspective assembly view of a screen printing kit constructed in accordance with the present invention and generally referenced by numeral 10. Kit 10 includes a housing 11, a frame 12 and a printing screen 13. Kit 10 further includes a plurality of printing inks such as inks 15 and 16 together with a pen 14, the function of which is set forth below in greater detail. While not seen in FIG. 1, it should be understood by those skilled in the art that screen printing kit 10 typically includes a plurality of screens generally similar to screen 13 and that a single screen is set forth herein for purposes of illustration. Similarly, while a pair of printing inks 15 and 16 are shown in FIG. 1, the user may utilize a great number of printing inks having different colors and characteristics without departing from the spirit and scope of the present invention.

Housing 11 is preferably formed of a molded plastic unit or the like having a generally planar bottom surface 27 encircled by a vertical extending integrally formed sidewall 20. Sidewall 20 defines an upper edge 22. Bottom surface 27 and sidewall 20 cooperate to form an interior cavity 21. To enhance the aesthetic appeal and interest value of screen printing kit 10, housing 11 is formed into a fanciful footprint configuration. However, it will be apparent to those skilled in the art that other fanciful configurations may be utilized without departing from the spirit and scope of the present invention.

Frame 12 is preferably formed of a molded plastic material or the like and defines a generally planar upper surface 32 having a downwardly extending sidewall 30. Sidewall 30 defines a lower edge 29 which in turn defines an inset groove 31 configured to receive a portion of upper edge 22 of housing 11 in order to provide a nesting fit or attachment between frame 12 and housing 11. Frame 12 further defines a generally rectangular recess 33 having an inwardly extending lip 34 forming a generally rectangular opening 39. As is set forth below in greater detail, recess 33 and lip 34 cooperate to provide a receiving support for printing screens such as screen 13. To better accomplish the locating and positioning of screens such as screen 13 in the printing process described below, a plurality of upwardly extending generally cylindrical locating posts 35, 36, 37 and 38 are supported upon lip 34 in a generally rectangular arrangement within recess 33.

In accordance with a further advantage of the present invention printing kit, frame 12 further defines a generally rectangular notch 40 having sidewalls 43 and 44 defined therein. A squeegee 41, preferably formed of a resilient material suitable for forming a wiping blade or squeegee defines a straight line edge 42 configured to be received within notch 40 of frame 12. In accordance with the above-described fanciful footprint-like appearance of housing 11 and frame 12, squeegee 41 further defines a multiply curved sidewall 45 which corresponds generally to the underlying portions of sidewall 20 formed in housing 11. To facilitate convenient storage of squeegee 41, notch 40 and sidewalls 43 and 44 are configured to receive edge 42 and the surrounding portions thereof of squeegee 41 in a snap-fit attachment. This snap-fit attachment may be provided using virtually any of the presently available attachment means, however, it has been advantageous to utilize the resilient character of the material forming squeegee 41 to provide a simple resilient attachment therebetween by fabricating notch 40 to slightly smaller width dimensions than the width of the corresponding interlocking portion of squeegee 41. Thus, squeegee 41 is resiliently captivated within notch 40 but is nonetheless easily removable for use by smaller children or the like.

Printing screen 13 includes a generally planar rectangular frame 50 defining a generally rectangular opening 51 therein. Frame 50 further defines a plurality of locating apertures 55, 56, 57 and 58 spaced in general correspondence to locating posts 35 through 38 respectively of frame 12. Printing screen 13 further includes a foraminous mesh or screen 52 which spans opening 51 and which is secured to frame 50 in accordance with conventional fabrication techniques such as adhesive bonding or the like. To enhance the stability and rigidity of frame 50 and thereby provide a printing screen more readily handled by young children or the like, frame 50 may comprise a pair of identical layers supported on either side of screen mesh 52 and mutually bonded thereto in a bonding attachment. In either event, screen mesh 52 receives and supports an impervious film or layer 53 which initially is completely impervious and thus blocks all mesh openings of screen mesh 52.

Figure 3:
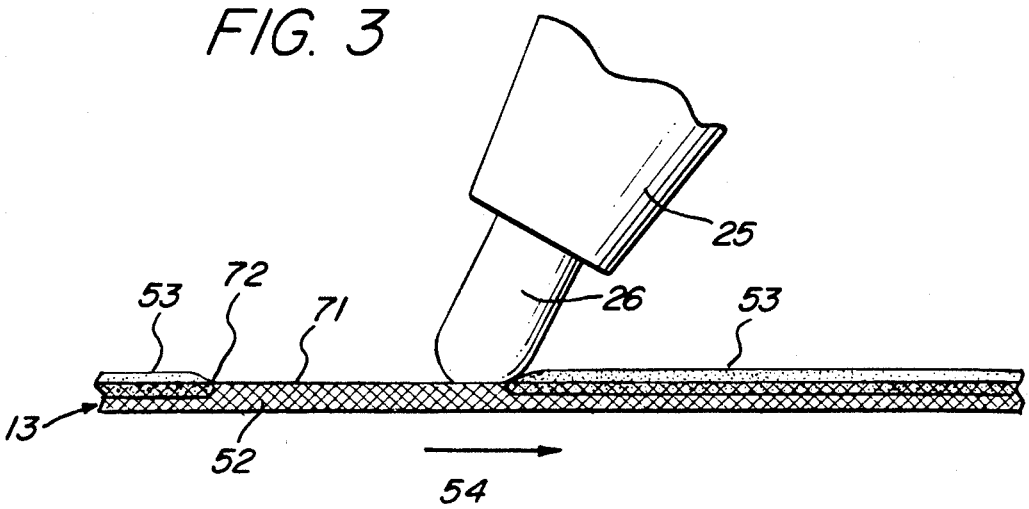
FIG. 3 sets forth a partial section view of the present invention screen printing kit taken along section lines 3—3 in FIG. 2.

Pen 14 includes a generally cylindrical pen body 23 having a writing tip 25 which in turn supports a porous writing nib 26 at one end thereof (seen in FIG. 3). Pen 14 further includes a removable cap 24 which is snap-fitted to body 23 in accordance with conventional fabrication techniques to cover tip 25 and nib 26 and prevent undesired drying of the liquid material (described below) within pen body 23.

In operation and in accordance with an important advantage of the present invention, kit 10 serves as a convenient storage unit for supporting pen 14 and a plurality of ink tubes such as ink tubes 15 and 16 together with a plurality of printing screens such as screen 13. In addition, the above-described attachment of squeegee 41 within notch 40 provides for convenient storage of squeegee 41. Thus, the entire assembled unit provided by kit 10 forms a convenient storage container having an interesting and fanciful appearance attractive to younger children. In addition, the user maintains an option of storing printing screens such as screen 13 either within interior cavity 21 of housing 11 or in a stacked arrangement upon posts 35 through 38 within recess 33. In either event, the convenient storage greatly enhances the appeal and practicality of the present invention screen printing kit.

Figure 2:
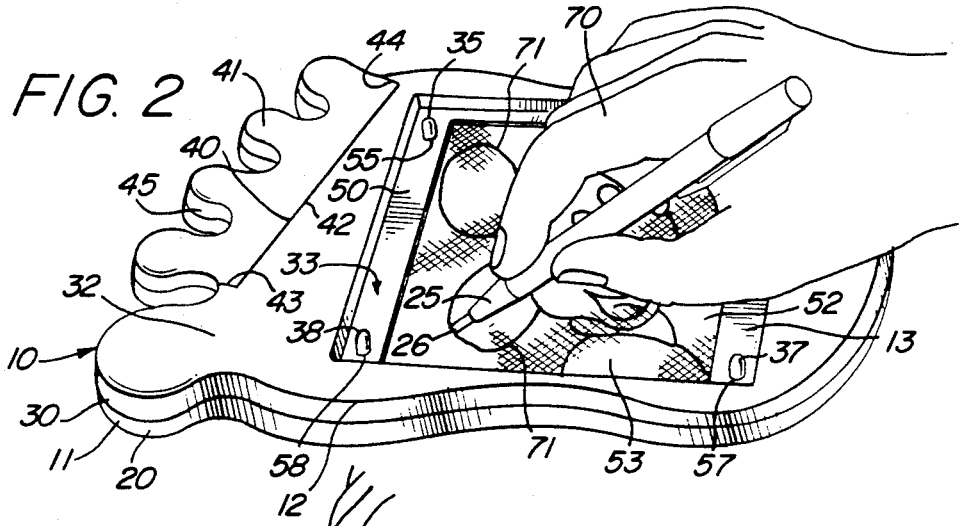
FIG. 2 sets forth a perspective view of the present invention screen printing kit in a typical pattern scribing activity.

FIG. 2 sets forth the initial operation used in producing an individualized design for screen printing in accordance with the present invention. In the arrangement of kit 10 shown in FIG. 2, frame 12 is received upon and supported by housing 11 and provides a convenient support therefor. Also, shown in FIG. 2, printed screen 13 has been inserted into recess 33 of frame 12 such that locating apertures 55 through 58 of frame 50 are received upon locating posts 35 through 38 respectively within recess 33 of frame 12. Thus, when so positioned, frame 12 supports and secures the position of printing screen 13 in a reliable fashion. It will be apparent to those skilled in the art that, under some circumstances, it may be preferable to undertake the drawing step of the screen printing process shown in FIG. 2 with frame 12 removed from housing 11 while screen 13 is received within recess 33 as described. This presents an alternative in accordance with the user's preference.

As mentioned above, screen 13 supports an impervious film layer 53 which completely covers screen mesh 52 and renders screen mesh 52 impervious to printing inks or other materials. In its preferred form, screen mesh 52 and film layer 53 are fabricated in accordance with the structure and process set forth in the above-referenced U.S. Pat. No. 4,550,660 issued to Sato, et al. As is set forth and described therein, screen mesh 52 remains impervious to materials such as printing ink so long as film layer 53 remains intact. To provide the creation of an individualized drawing such as drawing 71 upon screen mesh 52, the user grasps pen 14 in a conventional writing grasp using hand 70 such that pen body 23 is comfortably held and such that tip 25 of pen 14 extends downwardly to permit nib 26 to contact film layer 53 of screen 13. In further accordance with the above U.S. Pat. No. 4,550,660, pen body 23 is filled with a liquid material capable of dissolving film layer 53 in a localized process wherever film layer 53 is touched by nib 26. Thus, as the user exercises hand 70 and moves nib 26 about the surface of screen 13, the contact of nib 26 with the underlying portion of film layer 53 dissolves film layer 53 forming a drawing 71 in which the drawn lines thereof are pervious due to the dissolving of film layer 53. At the completion of the creation of drawing 71, printing screen 13 has been transformed from a completely impervious screen to a largely impervious screen having a drawing imposed thereon which is open or pervious to printing inks or similar materials.

FIG. 3 sets forth a partial section view of the present invention screen printing kit taken along section lines 3—3 in FIG. 2. Thus, pen tip 25 and nib 26 are positioned with respect to screen 13 such that nib 26 contacts film layer 53. As described above, screen 13 is initially covered by an impervious film layer 53 formed of a material readily dissolved by the liquid material within pen 14. In the position shown in FIG. 3, nib 26, having been brought into contact with film layer 53, is moving in the direction indicated by arrow 54. More specifically, nib 26 has moved from an initial position referenced by numeral 72 in the direction indicated by arrow 54 to the position presently shown. Correspondingly, drawing 71 characterized by the removal of film layer 53 is formed upon screen 13 from reference point 72 to the present position. As a result, the areas of screen mesh 52 still covered by film layer 53 remain impervious to printing inks or other materials while the area from which film layer 53 has been removed (drawing 71) is now pervious or open in accordance with the structure of screen mesh 52.

Figure 4:
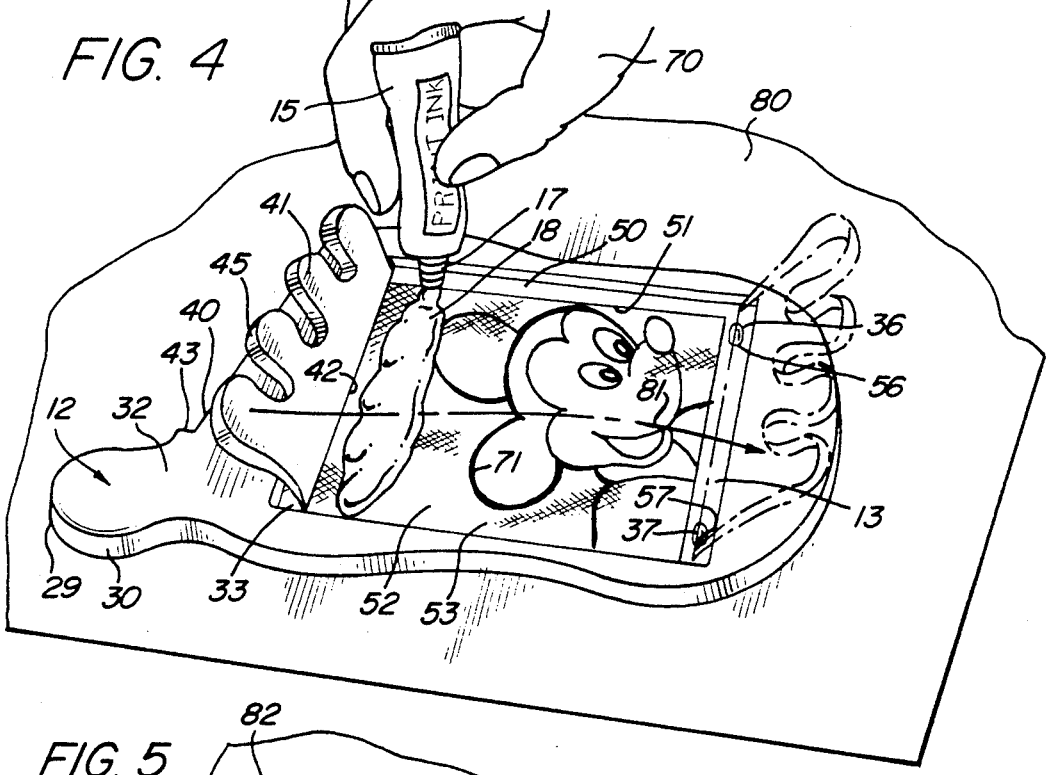
FIG. 4 sets forth a perspective view of the ink application or screening process step using the present invention screen printing kit.

FIG. 4 sets forth a perspective view of the next step in the individualized screen printing process in which drawing 71 is to be imposed upon a suitable medium such as medium 80. A variety of materials may be used for medium 80 such as cloth, paper or the like without limitation of the present invention. Thus, frame 12 having sidewall 30 and edge 29 is removed from housing 11 and rests upon medium 80 supported by edge 29 and sidewall 30. As mentioned above, frame 12 defines an upper surface 32 which in turn defines recess 33 having inwardly extending lip 34 therein. Screen 13, having drawing 71 imprinted thereon in the above-described process step remains within recess 33 being located and maintained by locating posts 35 through 38. As is also mentioned above, frame 12 includes a notch 40 which facilitates storage of squeegee 41. However, squeegee 41 which includes a wiping edge 42 and a multiply curved sidewall 45 is shown in FIG. 4 removed from notch 40 and positioned within recess 33 such that edge 42 extends downwardly upon printing screen 13. In preparation for the screening process, a user hand 70 is shown grasping tube of ink 15 such that neck 17 of tube 15 extends downwardly toward printing screen 13. As tube 15 is squeezed by hand 70, an elongated deposit of printing ink 18 is formed across screen 13. Once the desired quantity of printing ink is deposited upon screen 13, the user completes the screen printing process by carefully wiping screen 13 and ink 18 across the surface of screen 13 in the direction indicated by arrow 81 forcing the printing ink across drawing 71. In accordance with the structure of screen 13 and drawing 71 created in the above-described drawing process, the printing ink is able to penetrate screen 13 solely within the open areas which form drawing 71 but is otherwise precluded from reaching medium 80. Thus, a pattern of printing ink is transferred through printing screen 13 which corresponds to drawing 71.

Figure 5:
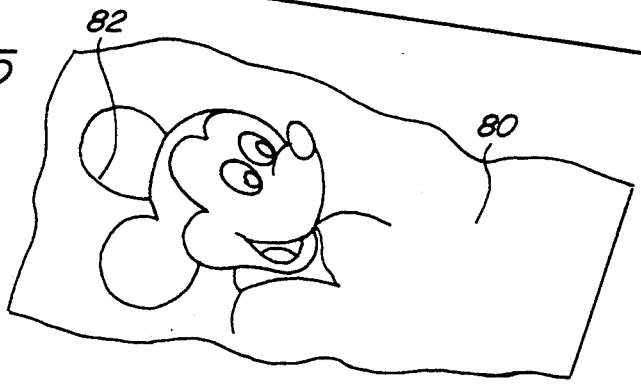
FIG. 5 sets forth a perspective view of the print medium following the application step of FIG. 4.

FIG. 5 sets forth medium 80 having imprinted thereon a plurality of printed lines of printing ink 82 which correspond to the open areas previously formed within drawing 71.

Once the desired print has been obtained upon medium 80, the child user may, alternatively, print the same design upon other print media using the same printing ink. Alternatively, the user may add further interest value to subsequent designs by depositing other ink colors and carrying forward the abovedescribed printing process to produce color variations. In addition, the user may prefer to remove screen 13 entirely from frame 12 and create additional screens in the manner described above for further printing activities. Once the printing desired to be accomplished is complete, the user may then simply clean-up the effected components of kit 10 and store the various components in the manner described above.

What has been shown is a convenient easy to use screen printing kit suitable for use by small children. The component is configured in an interesting and fanciful manner appealing to children and is formed of system components which are easily manipulated by younger children. The screen printing kit shown provides convenient storage of materials and is readily adapted to repeated use.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A screen printing kit, for use by children comprising:

a housing defining a planar bottom surface and a surrounding upwardly extending sidewall terminating in an upper edge;

a frame defining a planar upper surface having a sidewall extending downwardly therefrom, said frame defining a recessed portion, an extending lip extending inwardly within said recessed portion and defining an opening therein;

a plurality of locating posts extending upwardly from and spaced about said lip;

a squeegee removably attachable to said frame and having a straight wiping edge, said squeegee and said frame defining an outer border generally corresponding to said sidewall of said housing and nestably mating thereby forming an interior cavity therewith;

a printing screen receivable within said recess and having an open foraminous mesh portion, a surrounding frame defining a screen opening therein and a plurality of locating apertures corresponding to said locating posts;

an impervious solvent dissolvable material disposed upon said foraminous mesh rendering said mesh impervious; and a pen having a solvent for dissolving said impervious solvent dissolvable material and having a writing nib for transferring said solvent by contact, said pen, said ink and said screens being receivable within said interior cavity for storage when not in use.

2. A screen printing kit as set forth in claim 1 wherein said frame defines a generally rectangular notch and wherein said squeegee defines side portions on each side of said straight wiping edge and wherein said wiping edge and a portion of said side portions are receivable within said notch in a snap-fit attachment.

3. A screen printing kit as set forth in claim 2 wherein said housing and said frame in combination with said squeegee define corresponding outer borders resembling a fanciful footprint.

4. A screen printing kit as set forth in claim 3 wherein said recess and said printing screen are generally rectangular.

5. A screen printing kit as set forth in claim 4 wherein said sidewall of said frame defines a groove and wherein a portion of said upper edge of said housing is received within said groove.

6. A screen printing kit comprising:

a housing and frame defining matable side wall portions and defining an interior cavity therebetween, said frame defining an opening;

a screen formed of an open mesh material having a dissolvable film thereon;

means for removably securing said screen to said frame so as to overlie at least a portion of said opening in said frame;

a squeegee removably attachable to said frame; and a pen having a quantity of solvent capable of dissolving said film.

* * * * *